United States Patent [19]

Svat et al.

[11] Patent Number: 4,494,577

[45] Date of Patent: Jan. 22, 1985

[54] WEFT INSERTING DEVICE FOR JET LOOMS

[75] Inventors: Vladimir Svat; Ladislav Sévčik, both of Liberec, Czechoslovakia

[73] Assignee: Elitex, koncern textilniho strojirenstvi, Liberec, Czechoslovakia

[21] Appl. No.: 464,992

[22] Filed: Feb. 8, 1983

Related U.S. Application Data

[63] Continuation-in-part of Ser. No. 275,217, Jun. 19, 1981.

[30] Foreign Application Priority Data

Jun. 24, 1980 [CS] Czechoslovakia ..... 4451-80

[51] Int. Cl.[3] ..... D03D 47/30

[52] U.S. Cl. ..... 139/20; 139/435

[58] Field of Search ..... 139/116, 435, 20

[56] References Cited

U.S. PATENT DOCUMENTS 3,693,668 9/1972 Svaty ..... 139/435

FOREIGN PATENT DOCUMENTS 1535454 8/1969 Fed. Rep. of Germany ..... 139/435
2724872 11/1978 Fed. Rep. of Germany ..... 139/435
2825681 12/1979 Fed. Rep. of Germany ..... 139/20

*Primary Examiner*—Henry S. Jaudon

[57] ABSTRACT

An arrangement for the selective insertion of two weft yarns into two sheds of a jet loom with weft change. Each weft yarn is assigned a fixed jet provided with outlets into both sheds, and connected to two pressure air supplies, opened alternatingly according to a predetermined program. A plurality of such arrangements can be employed in combination with the said two sheds, the arrangements can be programmed to interact in a number of predetermined manners to produce a variety of fabric patterns.

6 Claims, 2 Drawing Figures

WEFT INSERTING DEVICE FOR JET LOOMS

Figure 1:
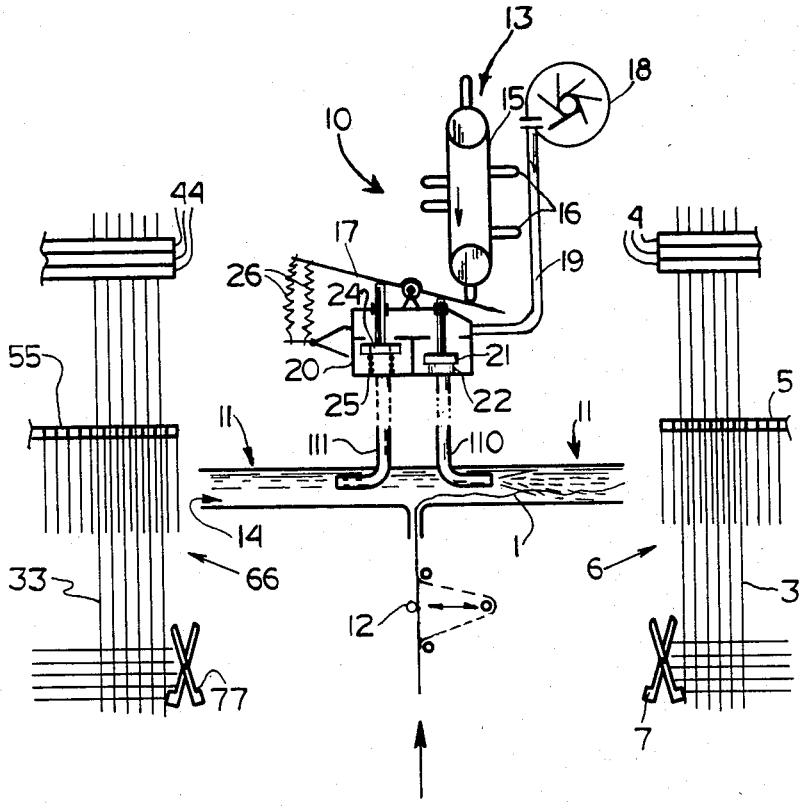

This application is a continuation-in-part of application Ser. No. 275,217, filed June 19, 1981.

The present invention relates to a device for inserting weft yarns into two weaving sheds of a jet loom with pick change.

The simultaneous insertion of two weft yarns into two different weaving sheds is known in jet looms with sheds arranged both one above the other and beside each other. One such arrangement is shown in Svaty, U.S. Pat. No. 3,693,668. In the case of arranging sheds beside each other, the weft inserting devices, as well as the jets as such, are disposed between the sheds in a so-called central jet insertion arrangement. It is a known fact that in sheds arranged in such manner it is possible to achieve patterning by means of programmed jet change of the jets inserting weft yarn into the shed, in which weft feeding into both weft inserting systems is continuous. For the purpose of achieving weft change, these devices transfer the jets toward the appurtenant sheds, e.g. by turning them through an angle of 180 degrees, or by another mechanical motion, for the purpose of performing weft change by the jets for programmed insertion into the shed. With high speed jet looms, the devices for mechanical jet change are complicated and expensive.

The above disadvantages are mitigated by the apparatus according to the present invention. In such apparatus, in contrast to the embodiment disclosed in the above referred-to Svaty patent, the jet of a first disclosed embodiment or the pair of jets of a second disclosed embodiment are disposed in a stationary manner, and they are able to project a weft thread either into the lefthand shed or into the righthand shed, depending on the direction of the air stream supplied to the jet or jets. When a single jet is used, it is necessary, with respect to operating conditions, to insure that weft insertion is carried out alternately, which means that while a weft thread is being inserted into the shed at one side of the loom, a beat-up of the already inserted weft thread takes place at the other side of the loom.

When two jets are used, in accordance with the second embodiment of the invention disclosed herein, there exist a considerable number of possible combinations as to how to insert the weft threads. For example, both of the jets can simultaneously insert a weft thread each into one and the same shed, or both of the jets can simultaneously insert a weft thread each into opposite sheds, the shed forming means operating in phase. Still further, the jets can insert a weft thread successively into opposite sheds in such way that while one of the jets inserts a weft thread into a shed at one side of the loom, a beat-up of a previously inserted weft thread is performed at the other side of the machine, the weft forming means then operating at a phase.

By assigning each weft yarn a jet with outlets into both sheds, the effect is achieved that the jet is constantly assigned to both sheds and does not change its assignment to the appurtenant sheds upon weft change. The actual weft change is performed by two pressure air supplies in each jet, such supplies being alternately opened in accordance with the perdetermined program, thus bringing about a transfer by means of air of the weft into the shed predetermined by the program. In this manner, the mechanical movement of the jets is eliminated, as well as possible also that of the weft guide. Moreover, the device according to the present invention is very simple in its construction and reliable in its operation.

Figure 2:
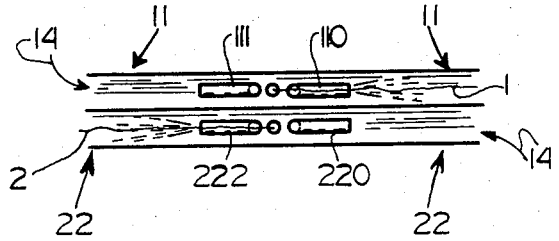

Further advantages and features of the present invention are described in the following specification and shown in the accompanying drawings, in which:

FIG. 1 is a diagram showing the central arrangement of the weft inserting mechanism with weft change in accordance with a first embodiment of the invention; and FIG. 2 is a fragmentary view in longitudinal section showing a part of a second embodiment of weft inserting mechanism with weft change in accordance with the present invention.

Turning first to the embodiment of FIG. 1, weft threads 3, which are controlled by heald-shafts 4 form, together with a reed 5, a first shed 6, which is oppositely arranged relative to a second shed, 66, formed by warp threads 33 and a reed 55.

Each weft thread 1 is assigned a jet 11 with outlets into both sheds 6 and 66. Each jet 11 is connected with two pressure air supplies 110, 111 which are controlled alternatingly by valves such as slide valves 21 and 24 of a control mechanism as shown generally at 10, mechanism 10 also including a programming device 13 having a driven belt 15 on which there are mounted appropriate projections 16 for tipping a valve-actuating lever 17, as shown.

A source of air under pressure, shown here as a fan 18, is connected by a conduit 19 to the housing 20 of a dual valve enclosing the slide valves 21 and 24. Slide valves 21 and 24 are constantly urged upwardly, into valve closed position, by "compression" springs 22 and 25, respectively. The valve-actuating lever 17 is constantly urged in a counter-clockwise direction by one or more coil tension springs 26. When the right hand end of first-class lever 17 is not engaged by one or more of the projections 16, slide valve 26 is in its upper, closed position, whereas slide valve 24 is in its lower, open position. However, when one or more of the projections 16 engages the right hand end of lever 17, as shown in FIG. 1, lever 17 is tipped clockwise whereby to thrust slide valve 21 downwardly into its open position against the opposition of the spring or springs 26, thus allowing spring 25 to thrust slide valve 24 upwardly into its closed position. It will be apparent that when the valve 21 is in its lower, open position, air under pressure enters the upper portion of the valve housing 20, passes through the now open port which cooperates with valve member 21, and flows into the curved pipe 110. The same action takes place when slide valve 24 is in its lower, open position: Air under pressure then flows through the open port in the valve housing which cooperates with the slide valve member 24, such air then flowing into the curved pipe 111.

In the beat-up position, there are provided weft severing devices 7 and 77, which are diagrammatically shown as scissors.

The modes of operation of the jets 11 are attained by means of a very simple construction. To enable a jet to operate as desired, it is sufficient to have a curved pipe 110, 111 for the supply pressure fluid inserted into the respective jet 11, as shown. Reversal of the direction of weft insertion in the embodiment of FIG. 1 is attained by the ejection effect of the pressure fluid, by the action of which the weft thread is drawn to the jet and turned to travel in a respective direction. Such jet causes atmospheric air to be drawn into the outer end of the opposite jet 11 as indicated by the curved arrow 14, such atmospheric air being entrained with the jet of air issuing from the curved pipe 110 and traveling therewith in a direction from left to right.

Withdrawal of the weft thread back into the jet can also be carried out mechanically by means of an alternatively employed swing lever 12 which forms the weft thread 1 into a loop shown in dotted lines in FIG. 1. It should be pointed out here that the principle of drawing the weft thread back into the jet is known, for example, in the above referred-to Svaty U.S. Pat. No. 3,693,668.

It should also be pointed out that in the valve system shown at 10, for the sake of simplification springs for the valves and for the operating lever which controls such valves have been omitted.

In FIG. 2 there is schematically shown an arrangement wherein, in addition to the single jet 11, which is the same as that in FIG. 1, there is also employed an additional jet 22, which is similar in construction to the above-described jet 11 of FIG. 1, jet 22 providing for the insertion of a second weft thread 2 in a direction from left to right, as shown, or alternatively in a direction from right to left. Jet 22 includes two sources of an air jet, 220 and 222, respectively. As above pointed out, both of the jets 11 and 22 of the embodiment of FIG. 2 can simultaneously insert a weft thread each into one and the same shed, or both of the jets 11 and 22 can simultaneously insert a weft thread each into opposite sheds, the shed forming means operating in phase. Still further, the jets 11 and 22 can insert a weft thread successively into opposite sheds in such a way that while one of the jets inserts a weft thread into a jet on one side of the loom, a beat-up of a previously inserted weft thread is performed at the other side of the loom; in such embodiment the shed forming means operate out of phase.

The apparatus of FIG. 2 operates as follows: Weft yarns 1 and 2 are prepared in a measuring device (not shown) and are fed into jets 11 and 22, respectively, provided with outlets into both sheds 6 and 66. Jets 11 and 22 are connected with two pressure air supplies 220 and 222, respectively, in alternating condition according to the predetermined program of their opening. Thus, for example, by opening the supply 110 of pressure air of jet 11, weft yarn 1 is inserted into shed 6.

Air supplies 220 and 222 are alternatingly opened according to a predetermined program, and weft yarn 2 is inserted alternatingly, according to a predetermined program, into shed 6 or 66, respectively. Upon inserting weft yarn 1 or 2, respectively, into shed 6, 66, said weft is transferred by reed 5 or 55, respectively, into the beat-up position and separated by separation device 7 or 77, respectively.

Although the invention is illustrated and described with reference to a plurality of preferred embodiments thereof, it is to be expressly understood that it is in no way limited to the disclosure of such preferred embodiments but is capable of numerous modifications within the scope of the appended claims.

We claim:

1. Apparatus for the insertion of weft yarns into two spaced sheds of a jet loom with weft change, comprising a stationary weft yarn impelling jet, said jet having two outlets cooperating with the respective sheds, two pressure air supplies for directing pressure air in the jet toward the respective outlets thereof, means for introducing weft yarns into the jet to be selectively acted upon by the respective air supplies, and means for supplying pressure air alternately to the respective air supplies according to a predetermined program, whereby to impel yarns in a selected shed of the loom.

2. Apparatus according to claim 1, wherein the two sheds are parallel and disposed side-by-side, the jet is disposed between the sheds, and the respective outlets of the jet are pointed in opposite directions toward the respective sheds.

3. Apparatus according to claim 2, comprising means to guide the weft yarns to a position midway between the outlets of the jet.

4. Apparatus for the insertion of two weft yarns into two spaced sheds of a jet loom with weft change, comprising two parallel stationary weft impelling jets, each of said jets having two outlets cooperating with the respective sheds, each jet being provided with two pressure air supplies for directing pressure air in the jet toward the respective outlets thereof, means for introducing weft yarns into each of the jets to be selectively acted upon by the respective air supplies thereof, and means for supplying fresher air alternately to the respective air supplies of each of the jets according to a predetermined program, whereby to impel yarns from a selected jet into a selected shed of the loom.

5. Apparatus according to claim 4, wherein the two sheds are parallel and disposed side-by-side, the jets are disposed between the sheds, and the respective outlets of the jets are pointed in opposite directions toward the respective sheds.

6. Apparatus according to claim 5, comprising means to guide the weft yarns to a position midway between the two outlets of each of the respective jets.

* * * * *